United States Patent [19]

Tremmel

[11] 4,432,843

[45] Feb. 21, 1984

[54] TRIVALENT CHROMIUM ELECTROPLATING BATHS AND PROCESSES USING THIAZOLE ADDITION AGENTS

[75] Inventor: Robert A. Tremmel, Woodhaven, Mich.

[73] Assignee: OMI International Corporation, Warren, Mich.

[21] Appl. No.: 403,196

[22] Filed: Jul. 29, 1982

[51] Int. Cl.[3] ..... C25D 3/06

[52] U.S. Cl. ..... 204/51; 204/DIG. 13; 210/723; 210/727; 210/728; 210/912

[58] Field of Search ..... 204/DIG. 13, 51, 43 R, 204/105 R; 210/727, 728, 729, 912, 723

[56] References Cited

U.S. PATENT DOCUMENTS

| | | | |
|---|---|---|---|
| 3,518,171 | 6/1970 | Merker et al. | 204/49 |
| 3,755,161 | 8/1973 | Yokota et al. | 210/912 X |
| 3,857,765 | 12/1974 | Merker et al. | 204/49 |
| 3,954,574 | 5/1976 | Gyllenspetz et al. | 204/43 T |
| 4,038,160 | 7/1977 | Crowther | 204/51 |
| 4,053,400 | 10/1977 | Merker et al. | 204/49 |

FOREIGN PATENT DOCUMENTS

| | | | |
|---|---|---|---|
| 53-25287 | 8/1978 | Japan | 210/729 |
| 244055 | 5/1969 | U.S.S.R. | 204/51 |

*Primary Examiner*—G. L. Kaplan
*Attorney, Agent, or Firm*—Richard P. Mueller

[57] ABSTRACT

An improved aqueous acidic trivalent chromium electrolyte and process for increasing the tolerance of such electrolytes to the presence of deleterious contaminating metal ions which normally progressively increase during commercial operation of the electrolyte ultimately resulting in chromium electrodeposits which are commercially unsatisfactory due to the presence of streaks, clouds and hazes in the deposit. The improved composition contains controlled effective amounts of thiazole and benzothiazole compounds which are effective to mask the adverse effects of such contaminating metal impurities and which also enhance the codeposition of such metal contaminants on the parts being plated thereby reducing, and in some instances preventing the progressive accumulation of such contaminating metal ions in the electrolyte. The invention further encompasses the process of rejuvenating trivalent chromium electrolytes which have been rendered deficient in their ability to deposit satisfactory chromium platings by a controlled addition of such additive agents followed by electrolyzing of the electrolyte to progressively reduce the concentration of contaminating metal ions to a level in which satisfactory performance of the electrolyte is restored.

26 Claims, No Drawings

TRIVALENT CHROMIUM ELECTROPLATING BATHS AND PROCESSES USING THIAZOLE ADDITION AGENTS

BACKGROUND OF THE INVENTION

The present invention broadly relates to trivalent chromium electrolytes, and more particularly to an improved trivalent chromium electrolyte composition which is substantially more tolerant to the presence of deleterious contaminating metal ions such as nickel, zinc, iron, copper and lead which accumulate and progressively increase in concentration during normal commercial operation of the bath. When one or more of such metal ion impurities attain concentration levels in which they are present in only relatively trace quantities, the chromium electrodeposit is adversely affected by the presence of black streaks, clouds and hazes which are sometimes further accompanied by a loss or reduction in covering power rendering such chromium electrodeposits commercially unsatisfactory.

In recognition of the problem associated with extraneous metal ion contamination of such trivalent chromium baths, it has heretofore been proposed in accordance with U.S. Pat. No. 4,038,160 to add small amounts of water soluble ferrocyanide compounds to the plating solution to effect a precipitation of such contaminating metal ions which thereafter are removed by filtration. While such proposed ferrocyanide treatment has been found effective in many instances, the treatment is costly and time consuming and the ferrocyanide precipitating agent itself can adversely affect the performance of the trivalent chromium electrolyte when employed in amounts that leave a residual excess of the precipitating agent dissolved in the bath. This necessitates further treatment by the intentional addition of contaminating metals to effect a precipitation of the excess precipitating agent present.

It has also been proposed to remove such contaminating metal ions through an electrolytic purification technique by which the bath is electrolyzed over a period of time employing a cathode on which a codeposition of the contaminating metal ions is effected. Unfortunately, while such an electrolytic purification technique is somewhat effective for reducing copper ion contamination, it is relatively ineffective for removing nickel and zinc ions and is only partially effective for removing iron.

The present invention provides an improvement over such prior art techniques by providing a trivalent chromium electrolyte which is more tolerant to the presence of one or more of such contaminating metal ions masking or hiding their deleterious effects thereby providing for a longer useful operating life of the bath under normal commercial operating conditions. Additionally, the present invention enhances the codeposition of such contaminating metal ions thereby substantially reducing the rate of buildup of concentration of such contaminating ions during the normal commercial operation of the bath which in those instances in which the rate of contamination is relatively low, is adequate in and of itself to prevent accumulation of such metal ions to levels at which deleterious results are obtained. The present invention further contemplates a method for rejuvenating or restoring the performance of a trivalent chromium electrolyte which has been detrimentally affected by the accumulation of such contaminating metal ions whereby the concentration thereof is reduced restoring the electrolyte to commercially satisfactory operating conditions.

SUMMARY OF THE INVENTION

The benefits and advantages of the present invention are achieved in accordance with the composition aspects thereof by an aqueous acidic trivalent chromium electrolyte containing trivalent chromium ions, a complexing agent for maintaining the trivalent chromium ions in solution, and a bath soluble additive agent present in an amount to increase the tolerance of the electrolyte to the presence of deleterious contaminating metal ions. The additive agent is selected from thiazole and benzothiazole compounds of the structural formula:

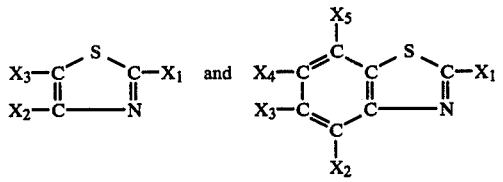

wherein:

$X_1$–$X_5$ are the same or different and are H, $NH_2$, $CH_3$, $NO_2$, halide, $C_1$–$C_6$ alkyl sulfonate, $C_1$–$C_6$ alkyl carboxylate, $C_1$–$C_6$ alcohol, S—R; in which R is H, $C_1$–$C_6$ alkyl sulfonate, $C_1$–$C_6$ alkyl carboxylate, $C_1$–$C_6$ alkyl alcohol.

In accordance with the process aspects of the present invention, a trivalent chromium electrolyte of improved tolerance to contaminating metal ions is produced by the addition to the electrolyte of a bath soluble and compatible thiazole and benzothiazole compound of the foregoing type in controlled effective amounts. Similarly, the present invention contemplates a process for restoring or rejuvenating a trivalent chromium electrolyte which has been rendered deficient in its ability to deposit commercially satisfactory chromium platings due to the accumulation of deleterious contaminating metal ions such as by the drag-in of contaminating solutions, the attack and dissolution of the substrates of metal articles being processed, impurities present in the water and chemicals employed for replenishing the bath, and the like whereby the thiazole or benzothiazole additive agent is added in controlled effective amounts whereafter the bath is electrolyzed to effect a codeposition of such contaminating metal ions on the cathode and the electrolyzation step is continued until the contaminating metal ion concentration is reduced to a level at which satisfactory chromium deposits can again be obtained.

The additive agent can be employed in amounts as low as about 1 mg/l to amounts as high as about 200 mg/l or higher depending upon the specific thiazole derivative or combination of derivatives employed without adverse effects to the plating performance of the trivalent chromium electrolyte. The presence of excessive amounts of the additive agent in the electrolyte at levels below about 200 mg/l is not detrimental to the bath and the additive agent progressively depletes during normal electrolysis of the bath.

Additional benefits and advantages of the present invention will become apparent upon a reading of the description of the preferred embodiments taken in conjunction with the specific examples provided.

DESCRIPTION OF THE PREFERRED EMBODIMENTS

The trivalent chromium electrolyte in accordance with the present invention contains trivalent chromium ions which range in concentration from about 0.2 to about 0.8 molar, and preferably from about 0.4 to about 0.6 molar. The trivalent chromium ions are suitably introduced in the form of any simple aqueous soluble and bath compatible salt such as chromium chloride hexahydrate, chromium sulfate, and the like. The electrolyte further contains a complexing agent for complexing the chromium ions present maintaining them in solution. The complexing agent may conveniently comprise formate ions, acetate ions or mixtures thereof of which the formate ion is preferred. The complexing agent is usually employed in concentrations of from about 0.2 to about 2.4 molar and in consideration of the trivalent chromium ion concentration. Conventionally, a molar ratio of complexing agent to chromium ions of about 1:1 to about 3:1 is used with ratios of about 1.5:1 to about 2:1 being preferred.

Additionally, such trivalent chromium electrolytes typically contain controlled amounts of conductivity salts which usually comprise salts of alkali metal or alkaline earth metals and strong acids such as hydrochloric acid and sulfuric acid. The use of such conductivity salts is well known in the art and their use minimizes power dissipation during the electroplating operation. Among suitable conductivity salts are potassium and sodium sulfates and chlorides as well as ammonium chloride and ammonium sulfate. A particularly satisfactory conductivity salt is fluoboric acid and the alkali metal, alkaline earth metal and ammonium bath soluble fluoborate salts. Such conductivity salts are usually employed in amounts up to about 300 g/l or higher to achieve the requisite conductivity while fluoborate ion concentrations of from about 4 to about 300 g/l are typical.

An optional and preferred constituent in the electrolyte comprises ammonium ions which have been found beneficial in enhancing the reducing efficiency of any reducing agents present for converting hexavalent chromium formed to the trivalent state. Particularly satisfactory results are obtained at molar ratios of total ammonium ion to chromium ion of from about 2:1 up to about 11:1, and preferably, from about 3:1 to about 7:1.

The bath may also advantageously contain halides of which chloride and bromide ions are preferred. The halide concentration is generally at least about 15 g/l and is usually controlled in relationship to the chromium concentration present at a molar ratio of about 0.8:1 up to about 10:1 with molar ratios of about 2:1 to about 4:1 of halide ions to chromium ions being preferred. The presence of such halide ions has been observed to also improve the effectiveness of reducing agents present in the bath to control formation of hexavalent chromium ions.

An optional but preferred constituent comprises a vanadium reducing agent of any of the types as disclosed in copending U.S. Patent application Ser. No. 205,406, filed Nov. 10, 1980 and now U.S. Pat. No. 4,392,922, the substance of which is incorporated herein by reference. The vanadium reducing agent is introduced in the form of any one of a variety of bath soluble and compatible vanadium salts present in an amount to provide a vanadium ion concentration of at least about 0.015 g/l up to about 6.3 g/l.

The trivalent chromium electrolyte can optionally and preferably further contain a buffering agent in an amount of about 0.15 molar up to bath solubility with amounts typically ranging up to about 1 molar. Preferably, the concentration of the buffering agent is controlled from about 0.45 to about 0.75 molar calculated as boric acid. The use of boric acid as well as the alkali metal and ammonium salts thereof as the buffering agent also is effective to introduce borate ions into the electrolyte which have been found to improve the covering power of the bath. Additionally, a wetting agent or mixtures of wetting agents can optionally and preferably be employed which may be of any of the types conventionally employed in nickel and conventional hexavalent chromium electrolytes. Such wetting agents may be anionic or cationic and are selected from those which are compatible and do not adversely affect the performance of the trivalent chromium electrolyte. Typically, wetting agents which can be satisfactorily employed include sulfosuccinates or sodium lauryl sulfate and alkyl ether sulfates alone or in combination with other compatible anti-foaming agents such as octyl alcohol, for example. The inclusion of such wetting agents has been found to contribute toward the attainment of clear chromium deposits eliminating dark mottled deposits and providing for improved coverage in low current density areas. Typically, such wetting agents can be employed in concentrations of up to about 1 gram per liter with amounts of about 0.05 to about 1 g/l being preferred.

Trivalent chromium electrolytes of the foregoing types are generally aqueous acidic solutions and contain hydrogen ions in a concentration to provide a pH on the acid side. Usually, the concentration of hydrogen ions is controlled to provide a pH of about 2.5 up to about 5.5 with a pH range of about 3.5 to about 4.0 being particularly satisfactory.

During commercial operation of such trivalent chromium electrolytes, a progressive contamination of the electrolyte occurs as a result of drag-in, dissolution in the electrolyte of the surfaces of the work pieces being plated, tank linings, work rack dissolution, causing a progressive buildup in the concentration of ions such as nickel, zinc, iron, copper and lead. It has been found by experimentation, that concentrations of nickel ions in amounts of about 150 ppm or higher are harmful and cause defects in the chromium electrodeposit. While the presence of iron ions in amounts up to about 500 ppm are beneficial in that they tend to promote coverage of the chromium deposit, concentrations of about 1,000 ppm (1 g/l) are harmful to the chromium deposit. Similarly, concentrations of copper ions in amounts above about 15 ppm and zinc ions above about 10 ppm and higher are harmful. Lead is harmful above about 5–10 ppm. However, it is usually not a problem in sulfate containing electrolytes since lead ions precipitate out as the insoluble lead sulfate salt and is removed by filtration. When combinations of such metal ions are present in the bath, the harmful effects are cumulative and lower concentrations of the individual metal ions produce defects in the chromium deposit which are generally evidenced by the appearance of black streaks, clouds, and hazes. Under severe contaminating conditions, the covering power of the electrolyte is also adversely effected.

In accordance with the present invention, it has been disovered that by the addition of controlled effective amounts of thiazole and benzothiazole compounds to the electrolyte, the tolerance of the electrolyte is unexpectedly increased with respect to the presence of such contaminating metal ions enabling commercially satisfactory chromium deposits to be obtained due to a masking or hiding effect of the additive. The use of the additive agent further substantially prolongs the useful operating life of the electrolyte necessitating less frequent treatments with precipitating agents to remove such harmful metal ions when their concentrations increase to objectionable levels. Additionally, the use of the additive agent further promotes a codeposition of such metal ions, particularly nickel and iron ions during normal electrolysis of the bath during plating operations which may be sufficient in and of itself for maintaining the contaminating ion concentration at acceptable levels under conditions of relatively mild contamination. The removal of nickel ions by electrolysis is particularly significant in that such trivalent chromium platings are normally deposited on nickel plated substrates which tend to promote contamination of the electrolyte with nickel ions.

The additive agent comprises a bath soluble and compatible thiazole and benzothiazole compound of the structural formula:

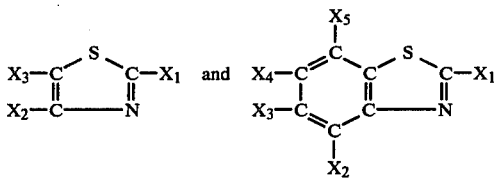

Wherein $X_1$–$X_5$ are the same or different and are H, $NH_2$, $CH_3$, $NO_2$, halide, $C_1$–$C_6$ alkyl sulfonate, $C_1$–$C_6$ alkyl carboxylate, $C_1$–$C_6$ alcohol, S—R; in which R is H, $C_1$–$C_6$ alkyl sulfonate, $C_1$–$C_6$ alkyl carboxylate, $C_1$–$C_6$ alkyl alcohol.

Compounds which have been found particularly satisfactory corresponding to the foregoing formula include 2-amino thiazole, 2-amino benzothiazole, 2-amino-thiazole propane sulfonate, 2-mercapto benzothiazole 2-propane sulfonate, as well as mixtures thereof. The addition of the additive agent in amounts as low as about 1 mg/l has been found to provide a benefit in the performance of the electrolyte. Usually, amounts of about 15 to about 30 mg/l are employed. It has been observed that when the concentration of the additive agent attains concentrations of about 200 mg/l or greater, an objectionable yellow color deposit is obtained in the low current density areas of the object being plated. The maximum concentration of the additive agent that can be employed will vary depending upon its specific structural formula, the conditions under which the electrolyte is operated and the configuration of the parts being plated. Since concentrations of the additive agent in amounts as high as about 200 mg/l and higher do not appear to provide any appreciable benefits in the control of the effects of contaminating metal ions present, it is usually preferred to maintain the concentration of such additive agent at levels below about 100 mg/l. The presence of amounts of the additive agent in excess of that required to control the contaminating metal ions present has been found not to produce any detrimental effects on the performance of the electrolyte and the excessive additive agent is progressively depleted during normal electrolysis of the bath. Accordingly, a periodic replenishment of the additive agent can be effected along with the other active constituents in the electrolyte to maintain its concentration within the desired range. Beneficial results are also obtained employing the additive agent of the present invention in trivalent chromium electrolytes as generally and specifically described in U.S. Pat. Nos. 3,954,574; 4,107,004; 4,169,022 and 4,196,063, the teachings of which are incorporated herein by reference.

In accordance with the process aspects of the present invention, the electrolyte of the various compositions disclosed incorporating the additive agent can be employed at operating temperatures usually ranging from about 15° to 45° C., preferably about 20° to about 35° C. Cathode current densities during electroplating can range from about 50 to about 250 amperes per square foot (ASF) with densities of about 75 to about 125 ASF being typical. The trivalent chromium electrolyte can be employed to plate chromium on conventional ferrous or nickel substrates, stainless steels as well as nonferrous substrates such as aluminum and zinc. The electrolyte can also be employed for chromium plating plastic substrates which have been subjected to a suitable pretreatment according to well-known techniques to provide an electrically conductive coating thereover such as a nickel or copper layer. The work pieces to be chromium plated are subjected to conventional pretreatments in accordance with well-known prior art practices and the electrolyte is particularly effective for depositing chromium platings on conductive substrates which have been subjected to a prior nickel plating operation.

The process of the present invention also contemplates a rejuvenation of a metal ion contaminated trivalent chromium electrolyte the performance of which has been rendered deficient to produce commercially satisfactory chromium deposits. The performance of the electrolyte is restored by the addition of the additive agent followed by an electrolyzing of the bath usually employing a nickel plated cathode for a period of time sufficient to reduce the concentration of the contaminating metal ions to acceptable levels by the codeposition thereof on the cathode. The inclusion of controlled effective amounts of the additive agent has been found particularly effective in reducing nickel ion contamination at levels above about 150 ppm.

In order to further illustrate the benefits of the present invention, the following specific examples are provided. It will be understood that the examples are provided for illustrative purposes and are not intended to be limiting of the scope of the present invention as herein disclosed and as set forth in the subjoined claims.

EXAMPLE 1

A 200 gallon pilot plating tank filled with a trivalent chromium electrolyte was provided of the following composition:

| INGREDIENT | CONCENTRATION |
|---|---|
| $Cr^{+3}$ | 24.2 g/l |
| $COOH^-$ | 31.3 g/l |
| $H_3BO_3$ | 57.1 g/l |
| $NH_4Cl$ | 150.0 g/l |
| $NaBF_4$ | 55.0 g/l |
| $VOSO_4$ | 1.0 g/l |

-continued

| INGREDIENT | CONCENTRATION |
|---|---|
| Wetting Agent* | 2.0 cc/l |

*Wetting agent comprises equivalent of 0.1344 g/l dihexyl ester of sodium sulfosuccinic acid and 0.244 g/l of the sodium sulfate derivative of 2-ethyl-1-hexanol.

Contamination of the electrolyte with iron, copper and nickel ions was effected by the addition of the corresponding sulfate salts to produce an iron ion concentration of about 338 ppm, copper ion concentration of about 42 ppm, and nickel ion concentration of about 122 ppm. An S-shaped steel panel which had been plated in a conventional Watts-type bright nickel bath at a cathode current density of about 45 ASF at 145° F. for a period of 10 minutes to provide a bright nickel deposit of about 0.3 mil thickness, after water rinsing was plated in the aforementioned contaminated trivalent chromium electrolyte for a period of 90 seconds at an average cathode current density of 100 ASF. The resulting chromium deposit was bright with fairly good coverage but had dark streaks over the entire high current density (HCD) and intermediate current density (ICD) areas. The dark streaks rendered the plating commercially unsatisfactory and is believed due to the high metallic impurity content, particularly nickel ions.

EXAMPLE 2

To the trivalent chromium electrolyte as described in Example 1 containing the contaminating metal ions, 25 mg/l of 2-amino thiazole was added and the panel plating test repeated under the same conditions as previously described. The resulting chromium deposit was overall bright with excellent coverage and no black streaks were observed. The chromium plating deposit was commercially satisfactory.

EXAMPLE 3

A commercial trivalent chromium bath of a nominal composition similar to that described in Example 1 was analyzed for nickel and iron ion contamination accumulated during normal electroplating operations. The nickel ion concentration was about 385 ppm and the iron ion concentration was about 162 ppm.

A conventional 3 inch by 4 inch Hull cell panel which had been plated in a conventional Watts-type bright nickel bath, water rinsed, was plated in a Hull cell employing a sample of the contaminated commercial trivalent chromium electrolyte at 5 amperes for 5 minutes. The resulting chromium deposit was dull with severe black streaks in the HCD areas. The black streaks are beleved due to the very high contaminating level of nickel ions in the bath. Two additional samples of the contaminated trivalent chromium electrolyte designated as sample A and sample B were placed in separate Hull cells and 50 mg/l of 2-amino thiazole were added to sample A. Nickel plated Hull cell panels were plated in both cells at 5 Amperes for 5 minutes. The chromium deposit obtained from the Hull cell panel plated in sample A showed a substantial improvement but was still of an appearance which is not generally commercially acceptable. The Hull cells containing samples A and B were thereafter further electrolyzed at 5 amps. for a period of 4 hours utilizing a nickel plated cathode whereafter the electrolytes were analyzed for nickel and iron ion concentration. Further electrolyzation of the Hull cells containing samples A and B was performed for an additional 16 hours and again analyzed. The results are as follows:

| | SAMPLE A | | SAMPLE B | |
|---|---|---|---|---|
| | $Ni^{++}$ | $Fe^{++}$ | $Ni^{++}$ | $Fe^{++}$ |
| Initial | 385 mg/l | 162 mg/l | 385 mg/l | 162 mg/l |
| After 4 Hrs. | 321 mg/l | 121 mg/l | 380 mg/l | 135 mg/l |
| After 20 Hrs. | 172 mg/l | 9 mg/l | 378 mg/l | 41 mg/l |

Further electrolysis of the sample A and B electrolytes did not appreciably reduce the nickel ion concentration. The results as set forth in the foregoing tables clearly indicate that the addition of 2-amino thiazole as evidenced by the results obtained on sample A is very effective for enhancing the codeposition of nickel by electrolysis at concentrations exceeding about 150 mg/l. The nickel ion concentration of sample B was substantially unchanged while the reduction in iron ion concentration was somewhat higher for sample A than obtained for sample B.

EXAMPLES 4 THROUGH 20

In order to evaluate the effectiveness of various additive agents corresponding to the structural formula as hereinabove set forth at different concentrations and in the presence of varying concentrations of contaminating nickel, copper and zinc metal ions, a trivalent chromium electrolyte was prepared nominally containing about 21.6 g/l trivalent chromium ions, about 67.2 g/l ammonium ions, about 103.3 g/l chloride ions, about 26.4 g/l boric acid, about 42.5 g/l of a mixture of sodium and ammonium formate as a complexing agent, about 55 g/l sodium fluoborate, about 1 g/l $VOSO_4$, and about 2 cc/l of a wetting agent of the same type disclosed in Example 1. Contaminating nickel, copper and zinc ions in controlled amounts were added by dissolving the corresponding sulfate salts thereof in separate batch samples of the trivalent chromium test electrolyte. A series of Hull cell panels 3 inches by 4 inches were preliminarily plated in a Watts-type bright nickel bath at 3 Amperes for 10 minutes and were thereafter employed for conducting chromium plating panel tests in the various trivalent chromium test solutions in a Hull cell operated at 5 Amperes for a period of three minutes at an electrolyte temperature of 80° F. The Hull panel plating tests provide a current density range of from 0 up to about 300 ASF.

In Example 4, the trivalent test electrolyte was adjusted to provide a nickel ion concentration of 75 ppm, a copper ion concentration of 5 ppm and a zinc ion concentration of 2 ppm. No additive agent was added and the panel test evidenced full coverage of the chromium deposit which was cloud-free and commercially acceptable.

In Example 5, the test electrolyte of Example 4 was adjusted to increase the nickel ion concentration to 225 ppm and the panel test repeated resulting in a chromium plate which provided full coverage but which had black clouds over the area ranging from 150 ASF to the high current density edge providing a commercially unacceptable deposit.

In Example 6, the test electrolyte of Example 5 was employed at the same contamination level but to which 15 mg/l of 2-amino thiazole was added and the panel test repeated. The addition of the additive agent provided full coverage of the chromium deposit which was cloud-free and commercially acceptable.

In Example 7, the test electrolyte of Example 5 was employed at the same contamination level but 20 mg/l of 2-amino benzothiazole were added and the panel test produced commercially satisfactory chromium deposits similar to those obtained in Examples 4 and 6.

In Example 8, 20 mg/l of 2-amino 4,5 dimethylthiazole was employed in lieu of 2-amino benzothiazole as employed in Example 7 and a commercially satisfactory chromium deposit was obtained similar to that obtained in Example 7.

In Example 9, 15 mg/l of 2-mercapto benzothiazole-2-propane sulfonate were employed to the test electrolyte of Example 5 and commercially satisfactory chromium plate deposits were obtained similar to those of Examples 7 and 8.

In Example 10, the test electrolyte devoid of any additive agents was adjusted to provide a nickel ion concentration of 325 ppm, at the same 5 ppm copper ion and 2 ppm zinc ion concentrations. A panel plating test resulted in a chromium deposit of full coverage with black clouds appearing on the plate from the 100 ASF to the high current density edge producing a commercially unacceptable deposit.

In Example 11, the test electrolyte of Example 10 was modified by the addition of 30 mg/l of 2-mercapto benzothiazole-2-propane sulfonate and the panel plating test evidenced a full plate coverage with a light brown stain appearing on the plating from the 125 ASF to the high current density edge producing an improved deposit but not commercially acceptable.

In Example 12, the test electrolyte of Example 11 was modified to double the concentration of the additive agent to 60 mg/l whereby the chromium deposit was of full coverage, cloud-free with a slight white haze in the 0 to 2.5 ASF range providing a deposit which is commercially acceptable.

For Example 13, the test electrolyte was adjusted to provide a nickel ion concentration of 200 ppm, a copper ion concentration of 5 ppm and a zinc ion concentration of 2 ppm. 10 mg/l of benzothiazole were added to the test electrolyte and a Hull panel plating test produced a full coverage deposit which was cloud-free and commercially acceptable similar to that obtained with Example 4.

In Example 14, the test electrolyte was modified to provide a nickel ion concentration of 75 ppm, an increased copper ion concentration of 25 ppm and a zinc ion concentration of 2 ppm. A panel test employing the test electrolyte without any additive agent produced a deposit having full coverage but with black clouds from the 100 ASF to the high current density edge producing a plating which is not commercially acceptable.

In Example 15, the test electrolyte of Example 14 was modified by the addition of 10 mg/l of 2-amino thiazole and a repeat of the plating test produced full coverage, cloud-free chromium deposit which was commercially acceptable.

In Example 16, a test electrolyte was adjusted to provide a nickel ion concentration of 75 ppm, a copper ion concentration of 5 ppm and an increased zinc ion concentration of 17 ppm. A panel test employing the test electrolyte without any additive agent evidenced a chromium deposit having a severe white swirl in the 40 to 175 ASF range and the absence of plate in the 0 to 20 ASF range resulting in a deposit which is commercially unacceptable.

In Example 17, the test electrolyte of Example 16 was modified to incorporate therein 15 mg/l of 2-mercapto benzothiazole-2-propane sulfonate and the plating test repeated. An improvement in the chromium deposit was obtained which still possessed a light white swirl in the 150 to 170 ASF range but which deposit was still considered not commercially acceptable.

In Example 18, a test electrolyte similar to that of Example 17 was employed but in which the additive agent concentration was increased to 30 mg/l. A panel plating test produced a chromium plating which was somewhat improved over that obtained in Example 17 but which had a light yellow appearance in the low current density area resulting in a deposit which is not considered as being generally acceptable from a commercial standpoint.

In Example 19, the electrolyte solution of Example 16 was employed to which 15 mg/l of 2-mercapto benzothiazole was added and the panel plating test produced a bright chromium deposit which had a skip-plate in the low current density area providing an electrodeposit which is marginally acceptable from a commercial standpoint.

In Example 20, the test electrolyte of Example 19 was employed but wherein the additive agent concentration was increased to 30 mg/l and the panel plating test produced results similar to that obtained in Example 19.

In the various test electrolyte solutions of Example 4–20 as previously described, the additive agent was added to the test electrolyte in the form of a concentrated aqueous solution in water with the exception of Examples 19 and 20 in which the additive agent was dissolved in a 20 percent solution of sodium hydroxide.

The results obtained on the electrolytes and panel tests of Examples 4 through 20 reveal the effectiveness of the additive agents for overcoming the deleterious effects of contaminating nickel and copper ions. The additive agents were not as effective in connection with the presence of high zinc ion contamination levels of about 17 ppm.

EXAMPLE 21

An experimental treatment of a commercial trivalent chromium electrolyte was performed which comprises a 4,000 gallon bath having a nominal composition corresponding to that described in Example 1. The performance of the electrolyte had become impaired due to the accumulation of iron and nickel contaminating ions during normal electroplating operations causing periodic black streak formation of the plate on the work pieces. Analyses of samples of the electrolyte before treatment revealed an iron ion concentration of about 1.3 g/l and a nickel ion concentration of about 0.5 g/l.

The treatment of the impaired electrolyte was performed without interrupting normal electroplating operations by first adding to the electrolyte 2-amino thiazole to provide a concentration of about 10 mg/l in the electrolyte. The intermittent black streaking of the electroplated parts disappeared and a corresponding quantity of 2-amino thiazle was added during each 8 hour shift of operation.

During the first shift of operation, a moderate purification treatment was also performed to effect a moderate precipitation of contaminating metal ions by the addition of 10 gallons of an aqueous solution containing 350 g/l of sodium diethyldithiocarbamate resulting in an immediate formation of a blue-black precipitate resulting from the reaction and precipitation of a portion of the contaminating iron and nickel ions from the bath. The moderate addition of the precipitating agent produced only a small quantity of precipitate which was readily removed by the conventional filtration equipment through which the trivalent chromium electrolyte is normally continuously circulated and filtered. The quantity of precipitating agent added is substantially below the stoichiometric quantity necessary to effect a substantially complete precipitation of the contaminating iron and nickel ions. By performing a mild precipitating treatment in conjunction with the masking effect of the 2-amino thiazole additive, no interruption in the normal operation of the bath was necessary since the quantity of precipitate formed did not interfere with the attainment of satisfactory chromium platings.

In the normal purification treatment of such trivalent chromium electrolytes, substantially large quantities usually equal or slightly in excess of that stoichiometrically required are employed producing copious amounts of precipitate which generally requires an interruption of operation of the electrolyte for a period of from about one up to about three hours to enable the precipitate to be removed. Continuous plating in the presence of such copious amounts of precipitate generally results in rough unacceptable chromium platings due to the inclusion of precipitate particles in the plate.

This example demonstrates a dual treatment of trivalent chromium electrolytes employing the additive agent of the present invention in combination with small quantities of precipitating agents whereby the detrimental effect of such contaminating metal ions is masked and excessive amounts are removed by precipitation without requiring an interruption of normal operation of the bath. Such a dual treatment can conveniently be performed each 8 hour shift of operation until the contaminating metal ions are reduced to a harmless concentration thereafter obviating the need for further treatment of the bath until such time that an accumulation of such deleterious metal ions again inhibits the satisfactory performance of the electrolyte. In addition to the diethyldithiocarbamate precipitating agent, alternative satisfactory precipitating agents include dimethyldithiocarbamate as well as bath soluble ferrocyanide compounds of the types disclosed in the aforementioned U.S. Pat. No. 4,038,160.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous acidic trivalent chromium electrolyte containing trivalent chromium ions, a complexing agent for maintaining the trivalent chromium ions in solution, halide ions and a bath soluble additive agent present in an amount to increase the tolerance of the electrolyte to the presence of deleterious contaminating metal ions, said additive agent being of the structural formula:

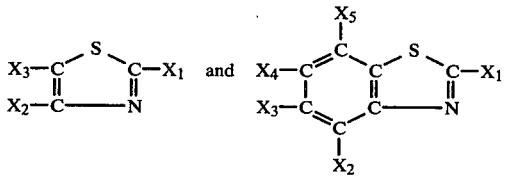

wherein:

$X_1$–$X_5$ are the same or different and are H, $NH_2$, $CH_3$, $NO_2$, halide, $C_1$–$C_6$ alkyl sulfonate, $C_1$–$C_6$ alkyl carboxylate, $C_1$–$C_6$ alcohol, S—R; in which R is H, $C_1$–$C_6$ alkyl sulfonate, $C_1$–$C_6$ alkyl carboxylate, $C_1$–$C_6$ alkyl alcohol.

2. The electrolyte as defined in claim 1 in which said additive agent comprises 2-amino-thiazole.

3. The electrolyte as defined in claim 1 in which said additive agent comprises 2-amino-benzothiazole.

4. The electrolyte as defined in claim 1 in which said additive agent comprises 2-amino-thiazole propane sulfonate.

5. The electrolyte as defined in claim 1 in which said additive agent comprises 2-mercapto benzothiazole 2-propane sulfonate.

6. The electrolyte as defined in claim 1 further containing ammonium ions.

7. The electrolyte as defined in claim 1 further containing vanadium ions present in an amount effective to maintain the concentration of hexavalent chromium ions at a level at which satisfactory chromium electrodeposits are obtained.

8. The electrolyte as defined in claim 1 further containing bath soluble and compatible conductivity salts present in an amount up to about 300 g/l.

9. The electrolyte as defined in claim 1 further containing borate ions.

10. The electrolyte as defined in claim 1 further containing a surfactant.

11. The electrolyte as defined in claim 1 having a pH of about 2.5 to about 5.5.

12. An aqueous acidic trivalent chromium electrolyte containing about 0.2 to about 0.8 molar trivalent chromium ions, a complexing agent for maintaining the trivalent chromium ions in solution present in a molar ratio of complexing agent to chromium ions of from about 1:1 to about 3:1, ammonium ions present in an amount to provide a molar ratio of ammonium ions to chromium ions of about 3:1 to about 7:1, halide ions present in an amount to provide a molar ratio of halide ions to chromium ions of about 0.8:1 to about 10:1, hydrogen ions present in an amount to provide a pH on the acid side and a bath soluble additive agent present in an amount sufficient to increase the tolerance of the electrolyte to the presence of deleterious contaminating metal ions, said additive agent of the structural formula:

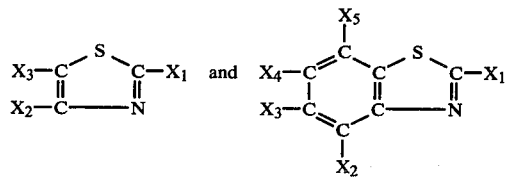

wherein:

$X_1$–$X_5$ are the same or different and are H, $NH_2$, $CH_3$, $NO_2$, halide, $C_1$–$C_6$ alkyl sulfonate, $C_1$–$C_6$ alkyl carboxylate, $C_1$–$C_6$ alcohol, S—R; in which R is H, $C_1$–$C_6$ alkyl sulfonate, $C_1$–$C_6$ alkyl carboxylate, $C_1$–$C_6$ alkyl alcohol.

13. The electrolyte as defined in claim 12 in which said additive agent is selected from the group consisting of 2-amino thiazole, 2-amino benzothiazole, 2-amino-thiazole propane sulfonate, 2-mercapto benzothiazole 2-propane sulfonate, and mixtures thereof.

14. The electrolyte as defined in claim 12 in which said additive agent is present in an amount of at least about 1 mg/l.

15. The electrolyte as defined in claim 12 in which said additive agent is present in an amount up to about 200 mg/l.

16. A process for improving the tolerance of aqueous acidic trivalent chromium electrolytes to the presence of deleterious contaminating metal ions which comprise the steps of adding to said electrolyte a bath soluble additive agent of the structural formula:

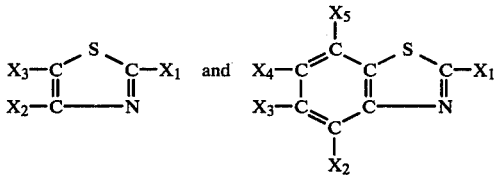

wherein:

$X_1$–$X_5$ are the same or different and are H, $NH_2$, $CH_3$, $NO_2$, halide, $C_1$–$C_6$ alkyl sulfonate, $C_1$–$C_6$ alkyl carboxylate, $C_1$–$C_6$ alcohol, S—R; in which R is H, $C_1$–$C_6$ alkyl sulfonate, $C_1$–$C_6$ alkyl carboxylate, $C_1$–$C_6$ alkyl alcohol, and electrolyzing the electrolyte to deposit chromium on a cathode.

17. The process as defined in claim 16 in which said additive agent is added in an amount of at least about 1 mg/l.

18. The process as defined in claim 16 in which said additive agent is added in an amount up to about 200 mg/l.

19. The process as defined in claim 16 in which said additive agent is selected from the group consisting of 2-amino thiazole, 2-amino benzothiazole, 2-aminothiazole propane sulfonate, 2-mercapto benzothiazole 2-propane sulfonate, and mixtures thereof.

20. The process for rejuvenating an aqueous acidic trivalent chromium electrolyte which has been rendered deficient in its ability to deposit a satisfactory chromium plate due to the accumulation of deleterious contaminating metal ions therein which comprise the steps of adding to said electrolyte a bath soluble additive agent of the structural formula:

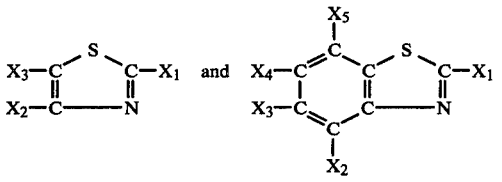

wherein:

$X_1$–$X_5$ are the same or different and are H, $NH_2$, $CH_3$, $NO_2$, halide, $C_1$–$C_6$ alkyl sulfonate, $C_1$–$C_6$ alkyl carboxylate, $C_1$–$C_6$ alcohol, S—R; in which R is H, $C_1$–$C_6$ alkyl sulfonate, $C_1$–$C_6$ alkyl carboxylate, $C_1$–$C_6$ alkyl alcohol, electrolyzing the electrolyte to electrodeposit chromium and the contaminating metal ions on a cathode for a period of time sufficient to reduce the concentration of said contaminating metal ions to an acceptable level and thereafter resuming the electrodeposition of chromium on work pieces.

21. The process as defined in claim 20 in which the contaminating metal ion is copper and the step of electrolyzing the electrolyte is continued until the copper ion concentration is reduced to a level below about 15 ppm.

22. The process as defined in claim 20 in which the contaminating metal ion is nickel and the step of electrolyzing the electrolyte is continued until the nickel ion concentration is reduced to a level below about 150 ppm.

23. The process as defined in claim 20 in which the contaminating metal ion is iron and the step of electrolyzing the electrolyte is continued until the iron ion concentration is reduced to a level below about 1 g/l.

24. A process for rejuvenating an aqueous acidic trivalent chromium electrolyte which has been rendered deficient in its ability to deposit a satisfactory chromium plate due to the accumulation of delterious contaminating metal ions therein which comprises the steps of adding to said electrolyte a bath soluble additive agent in an amount effective to at least partially mask the detrimental effect of the contaminating metal ions on the chromium plate, said additive agent of the structural formula:

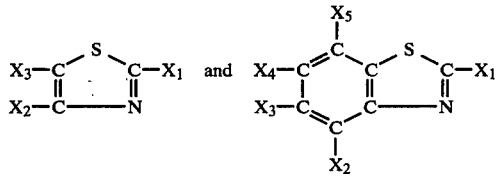

wherein:

$X_1$–$X_5$ are the same or different and are H, $NH_2$, $CH_3$, $NO_2$, halide, $C_1$–$C_6$ alkyl sulfonate, $C_1$–$C_6$ alkyl carboxylate, $C_1$–$C_6$ alcohol, S—R; in which R is H, $C_1$–$C_6$ alkyl sulfonate, $C_1$–$C_6$ alkyl carboxylate, $C_1$–$C_6$ alkyl alcohol, adding in the presence of said additive agent a precipitating agent in an amount less than the stoichiometric amount required to precipitate all of the contaminating metal ions present to effect a precipitation of a portion thereof, and separating the precipitate from the electrolyte.

25. The process as defined in claim 24 in which said precipitating agent comprises bath soluble ferrocyanide compounds.

26. The process as defined in claim 24 in which said precipitating agent comprises a bath soluble compound to provide ions selected from the group consisting of dimethyldithiocarbamate ions, diethyldithiocarbamate ions and mixtures thereof.

* * * * *